US011118301B2

(12) United States Patent
Lee et al.

(10) Patent No.: US 11,118,301 B2
(45) Date of Patent: Sep. 14, 2021

(54) DETERGENT SUPPLY DEVICE FOR WASHING MACHINE

(71) Applicant: LG ELECTRONICS INC., Seoul (KR)

(72) Inventors: Hyunseung Lee, Seoul (KR); Joongil Shin, Seoul (KR); Sanghee Yoo, Seoul (KR); Youngho Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/509,129

(22) Filed: Jul. 11, 2019

(65) Prior Publication Data

US 2020/0018011 A1 Jan. 16, 2020

(30) Foreign Application Priority Data

Jul. 13, 2018 (KR) ..... 10-2018-0081775

(51) Int. Cl.
*D06F 39/02* (2006.01)

(52) U.S. Cl.
CPC ..... *D06F 39/028* (2013.01)

(58) Field of Classification Search
None
See application file for complete search history.

(56) References Cited

U.S. PATENT DOCUMENTS

2005/0241347 A1* 11/2005 Cho ..... D06F 39/028 68/243

FOREIGN PATENT DOCUMENTS

DE 112005000834 T5 2/2007

OTHER PUBLICATIONS

DE Office Action in German Appln No. 102019118962.4, dated Mar. 30, 2021, 9 pages (with English translation).

* cited by examiner

*Primary Examiner* — Cristi J Tate-Sims
(74) *Attorney, Agent, or Firm* — Fish & Richardson P.C.

(57) ABSTRACT

A detergent supply device of a washing machine is disclosed, which comprises a dispenser provided on a water supply path of the washing machine and connected with a plurality of hoses; and a detergent box arranged to be drawn out inside the dispenser and provided with a plurality of detergent accommodating portions partitioned to be more than the plurality of hoses, wherein the dispenser supplies at least one path through which washing water supplied from one of the plurality of hoses moves by diverging the washing water to at least two of the plurality of detergent accommodating portions.

16 Claims, 4 Drawing Sheets

DETERGENT SUPPLY DEVICE FOR WASHING MACHINE

CROSS-REFERENCE TO RELATED APPLICATIONS

This application claims the benefit of Korean Patent Application No. 10-2018-0081775, filed on Jul. 13, 2018, which is hereby incorporated by reference as if fully set forth herein.

FIELD

The present invention relates to a detergent supply device of a washing machine, and more particularly, to a detergent supply device of a washing machine in which a washing water supply structure of the detergent supply device is improved.

BACKGROUND

Generally, a washing machine is an appliance that washes laundry through washing, rinsing and dehydrating courses to remove various contaminants attached to clothes, bedding, etc. in a drum by using an action between washing water and a detergent.

In the washing machine, a tub in which washing water is accommodated is arranged, a drum in which laundry is accommodated is rotatably arranged at an inner side of the tub, and a motor for generating a driving force of the drum is provided at one side of the tub.

Also, a water supply device and a detergent supply device are provided in the washing machine to supply washing water and a detergent to the tub, and the detergent supply device is provided on a water supply path of the water supply device and thus communicated with the water supply path.

The detergent supply device of the related art, as shown in FIG. 1, includes a detergent box 10 in which a plurality of detergent accommodating portions 12, 14, 16 and 18 are partitioned, and a dispenser 20 in which the detergent box 10 is stored to be drawn out and thus to supply detergents of the detergent accommodating portions 12, 14, 16 and 18 to the tub together with the washing water by supplying the washing water from the water supply device to the detergent accommodating portions 12, 14, 16 and 18.

In this case, the plurality of detergent accommodating portions 12, 14, 16 and 18 are partitioned by a partition 30 such that various detergents (for example, powder detergent, liquid detergent, fabric softener, bleach, etc.) required for washing of laundry are separately accommodated in the detergent accommodating portions, and each of the detergent accommodating portions 12, 14, 16 and 18 is formed to have an upper surface which is opened.

Meanwhile, the dispenser 20 is provided with a plurality of water supply holes 22, 24, 26 and 28 formed at an upper side of the detergent box 10 to supply the washing water flowing from the outside of the washing machine to the plurality of detergent accommodating portions 12, 14, 16 and 18. In this case, the water supply holes 22, 24, 26 and 28 are respectively formed to correspond to the plurality of detergent accommodating portions 12, 14, 16 and 18.

In the detergent supply device of the related art configured as above, if washing water enters the inside of the dispenser 20 through the water supply device, the washing water is supplied to the detergent accommodating portions 12, 14, 16 and 18 of the detergent box 10 through the water supply holes 22, 24, 26 and 28 of the dispenser 20, and the detergents accommodated in the detergent accommodating portions 12, 14, 16 and 18 may be discharged to the outside of the detergent box 10 together with the washing water and then supplied into the tub by the dispenser 20.

Meanwhile, in the detergent supply device of the related art described as above, the water supply device should be provided with a plurality of paths and a plurality of water supply valves corresponding to the respective water supply holes so as to supply the washing water to each water supply hole.

That is, the dispenser 20 is provided with a plurality of paths connected with the respective water supply holes 22, 24, 26 and 28 to supply washing water to the respective detergent accommodating portions 12, 14, 16 and 18 in accordance with the number of the detergent accommodating portions 12, 14, 16 and 18, and paths of the water supply device are connected to correspond to the respective paths, and a plurality of water supply valves for controlling washing water supplied through each path should be provided in each path.

In this way, if the paths and the water supply valves are increased as the number of the detergent accommodating portions 12, 14, 16 and 18 is increased, a problem occurs in that the manufacturing cost of the washing machine is increased. For this reason, a problem also occurs in that processes are increased.

SUMMARY

Accordingly, the present invention is directed to a detergent supply device of a washing machine that substantially obviates one or more problems due to limitations and disadvantages of the related art.

An object of the present invention is to provide a detergent supply device of a washing machine in which paths of a detergent supply device are improved to reduce the number of water supply valves for supplying washing water to the detergent supply device.

Another object of the present invention is to provide a detergent supply device of a washing machine in which paths of a detergent supply device are improved to reduce the number of processes according to manufacture of the washing machine.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a detergent supply device of a washing machine according to one embodiment of the present invention comprises a dispenser provided on water supply paths of the washing machine and connected with a plurality of hoses; and a detergent box arranged to be drawn out inside the dispenser and provided with a plurality of detergent accommodating portions partitioned to be more than the plurality of hoses, wherein the dispenser supplies at least one path through which washing water supplied from one of the plurality of hoses moves by diverging the washing water to at least two of the plurality of detergent accommodating portions.

Preferably, the dispenser further includes a connecting unit connected with one of the plurality of hoses, a water supply path extended from the connecting unit, supplying washing water to one of the plurality of accommodating portions, and a partition portion provided in the water supply path, partially supplying the washing water passing through the water supply path to another one of the plurality of accommodating portions.

Preferably, the partition portion further includes a divergence portion forming a space, where the washing water enters, at one side of the water supply path, extended to an opposite direction of a moving direction of the washing water moving along the water supply path to partially guide the washing water to the partition portion.

Meanwhile, it is preferable that the dispenser includes a lower panel provided with a plurality of connecting units connected with the plurality of hoses and provided with a plurality of water supply paths formed to guide washing water supplied from each connecting unit to the plurality of detergent accommodating portions, and an upper panel for shielding an upper portion of the lower panel.

Otherwise, it is preferable that at least one of the plurality of water supply paths further includes a partition portion extended from the connecting unit, supplying washing water to one of the plurality of accommodating portions and at the same time partially supplying the washing water to another one of the plurality of accommodating portions.

Also, it is preferable that at least one of the plurality of water supply paths further includes a partition portion forming a space, where the washing water enters, at one side, and a divergence portion extended to an opposite direction of a moving direction of the washing water to partially guide the washing water to the partition portion.

Also, it is preferable that the dispenser includes a dispenser housing provided at one side of the washing machine, forming a space where the detergent box is drawn out, and guiding a detergent and washing water to a tub, and a dispenser cover provided at an upper portion of the dispenser housing, individually supplying washing water to the plurality of detergent accommodating portions formed in the detergent box.

According to the detergent supply device of the washing machine according to one embodiment of the present invention, the paths of the detergent supply device may be improved to reduce the number of water supply valves for supplying washing water to the detergent supply device.

Also, according to the detergent supply device of the washing machine according to one embodiment of the present invention, the paths of the detergent supply device may be improved to reduce the number of processes according to manufacture of the washing machine.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a detergent supply device of a washing machine according to one embodiment of the present invention will be described in detail with reference to the accompanying drawings.

Titles of elements defined in description of the present invention are defined in consideration of their functions in the present invention. Therefore, the titles of elements should not be understood to restrict technical elements of the present invention. Also, the titles defined in the respective elements may be referred to as other titles in the art to which the present invention pertains.

Therefore, the present invention is not limited to the following embodiments, and various modifications and corrections may be made in the embodiments of the present invention by persons skilled in the art to which the present invention pertains within the scope of the present invention.

First of all, a washing machine according to one embodiment of the present invention will briefly be described with reference to the accompanying drawings. For convenience of description, a detailed description of the same elements as those of the related art will be omitted, and only a portion related to the present invention will be described in detail.

Figure 1:
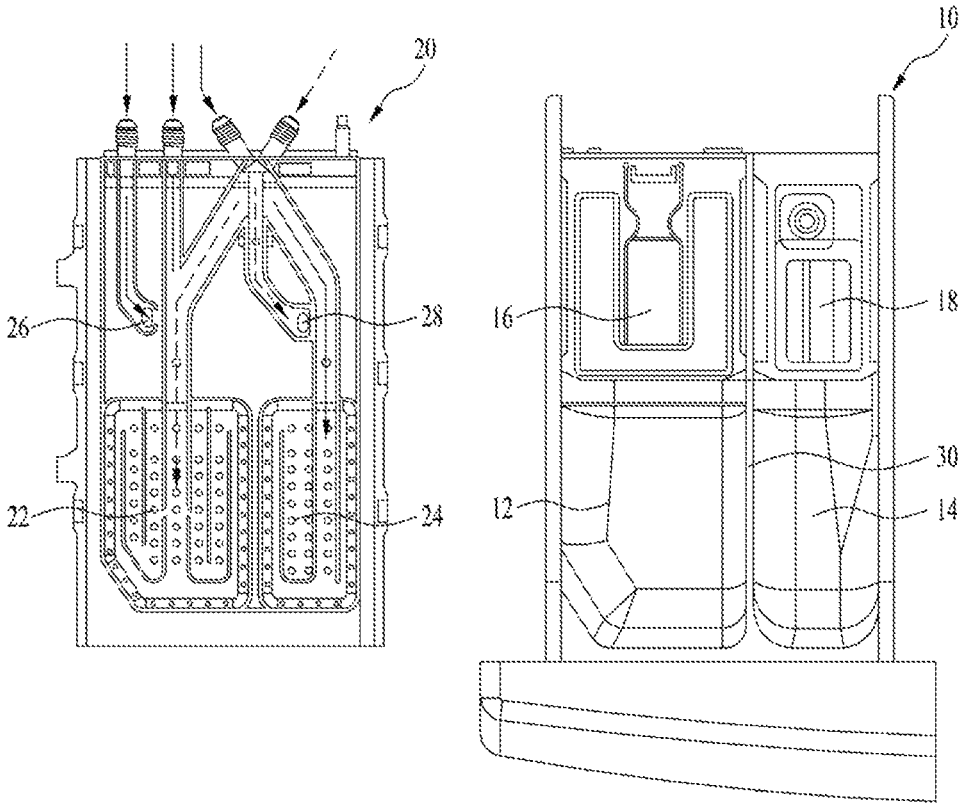
FIG. 1 is an exploded plane view illustrating a detergent supply device according to the related art.
Figure 2:
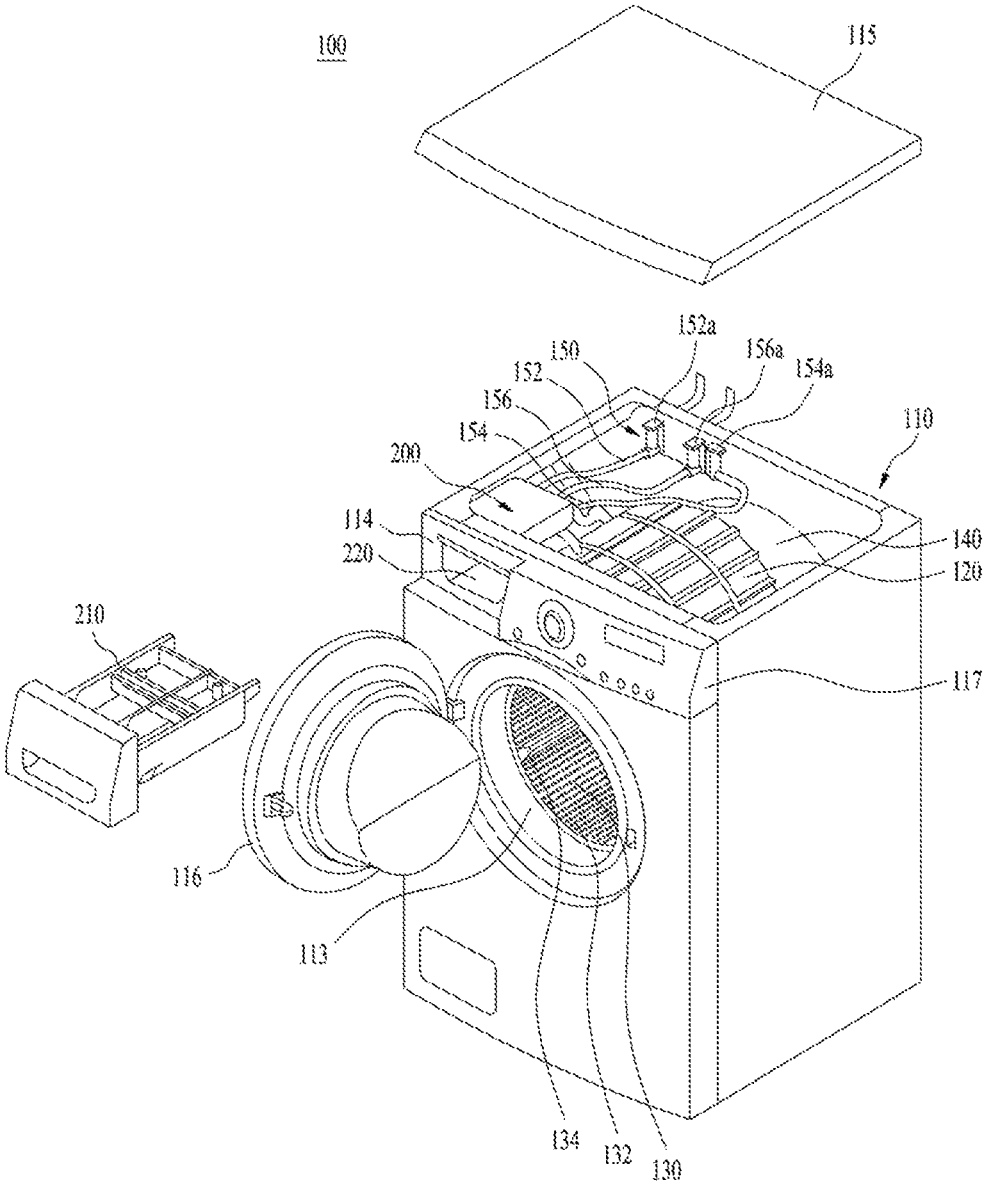
FIG. 2 is an exploded perspective view illustrating a washing machine according to one embodiment of the present invention.

FIG. 2 is an exploded perspective view illustrating a washing machine according to one embodiment of the present invention.

The washing machine according to one embodiment of the present invention, as shown in FIG. 2, includes a cabinet 110 forming an external appearance of the washing machine 100, a tub 120 horizontally provided to be buffered by a spring (not shown) and a damper (not shown) inside the cabinet 110, a drum 130 rotatably arranged inside the tub 120 and provided with a plurality of dehydrating holes 132 formed on an outer circumferential surface, a motor 140 provided at a rear portion of the tub 120 to transfer a rotational force to the drum 130, a water supply device 150 for controlling inflow of washing water from an external water supply source, a spray nozzle (not shown) for spraying the washing water supplied from the external water supply source into the drum 130, and a detergent supply device 200 in which a detergent is accommodated and mixed with the washing water.

A cabinet cover 112 provided with a laundry hole 113 formed at the center is provided at the front of the cabinet 110, and a top plate 115 is arranged on the cabinet 110. In this case, a door 116 for opening or closing the laundry hole 113 is rotatably provided in the cabinet cover 112, and a control panel 117 for displaying and manipulating an operation of the washing machine 100 is provided on an upper side of the cabinet cover 112. Also, a draw-out hole 114 provided with the detergent supply device 200 is provided at one side of the control panel 117.

The water supply device 150 is arranged below the top plate 115, and includes water supply hoses 152, 154 and 156 and water supply valves 152*a*, 154*a* and 156*a* for supplying washing water into the tub 120.

Meanwhile, the water supply valves 152*a*, 154*a* and 156*a* are provided on a rear surface of the cabinet 110 to pass therethrough, and include a hot water valve 152*a* for inflowing hot water from the outside, and first and second cold water valves 154*a* and 156*a* for inflowing cold water from the outside.

Since the water supply hoses 152, 154 and 156 are provided between each of the water supply valves 152*a*, 154*a* and 156*a* and the detergent supply device 200 to guide washing water to the detergent supply device 200, the water supply hoses 152, 154 and 156 include a hot water hose 152 connected between the hot water valve 152*a* and the detergent supply device 200, and first and second cold water hoses 154 and 156 connected between the first and second cold water valves 154*a* and 156*a* and the detergent supply device 200.

The spray nozzle is to directly spray washing water into the drum 130, and is generally arranged at the front of the tub 120 to diffuse and spray the washing water to an insertion hole of the drum 130. Preferably, the spray nozzle is provided above a gasket (not shown) for connecting the tub 120 with the cabinet cover 112. In accordance with the embodiment, the spray nozzle may be arranged at various positions, for example, below the gasket or between the gasket and the cabinet cover 112, in the cabinet cover 112 or the tub 120. Preferably, the spray nozzle is an atomizing nozzle for spraying washing water to an inner circumferential surface and a rear surface of the drum 130 by making the washing water miniature.

Since the detergent supply device 200 is provided to be communicated between the water supply hoses 152, 154 and 156 and a water supply bellows 226, the detergent supply device 200 supplies the detergent into the tub 120 together with the washing water supplied into the tub 120, and supplies separate washing water to the spray nozzle. The detergent supply device 200 is provided at the rear of the draw-out hole 114 formed in the control panel 117 and therefore the detergent box 210 is drawn out to the front of the washing machine 100.

Hereinafter, the detergent supply device according to one embodiment of the present invention will be described in detail with reference to the accompanying drawings.

Figure 3:
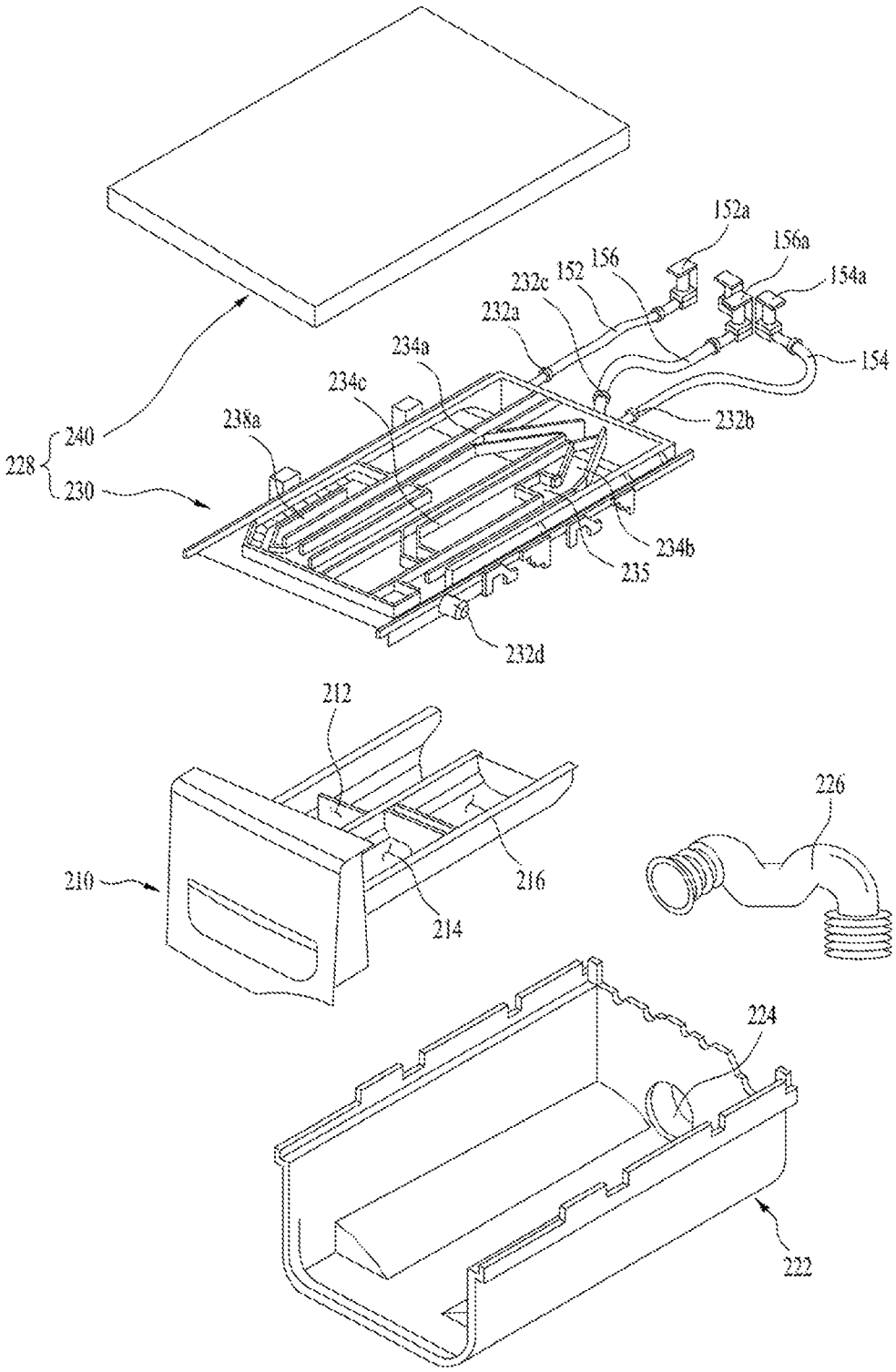
FIG. 3 is an exploded perspective view illustrating a detergent supply device of a washing machine according to one embodiment of the present invention.
Figure 4:
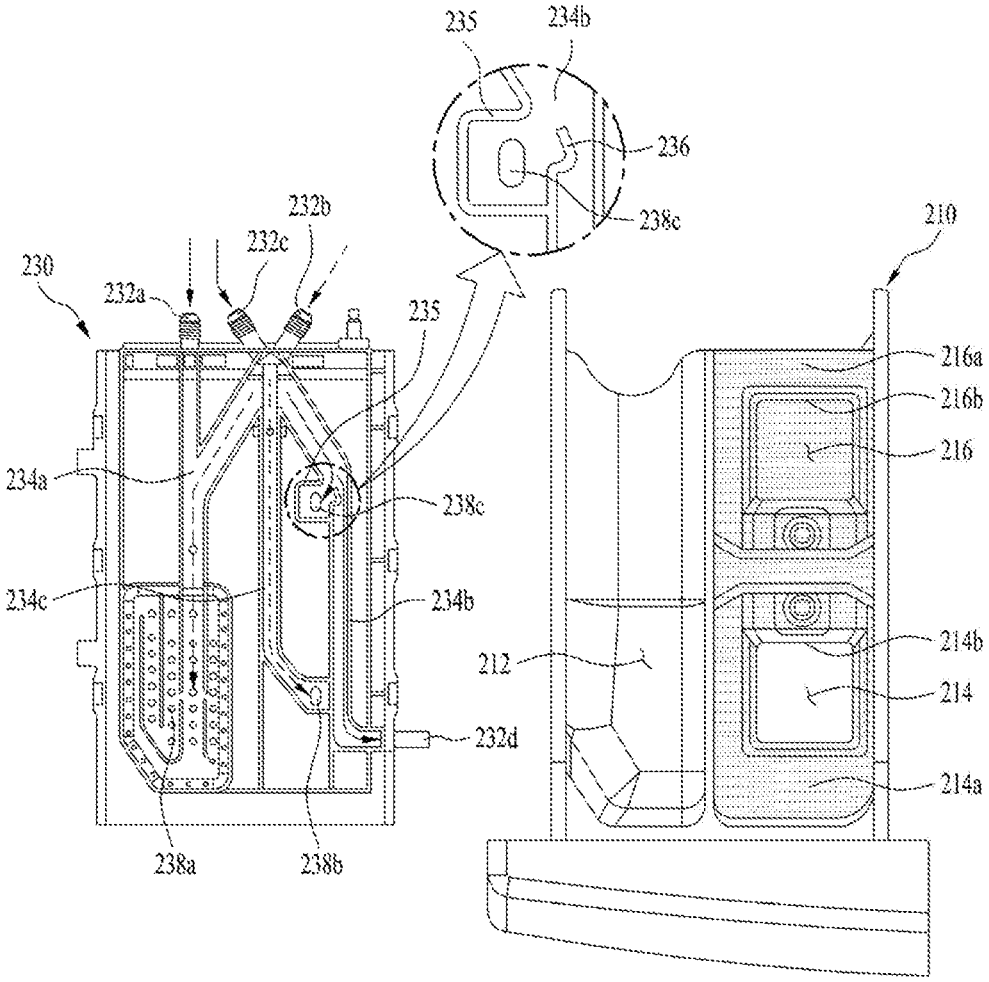
FIG. 4 is a plane view illustrating a detergent box and a dispenser cover of a detergent supply device according to one embodiment of the present invention.

FIG. 3 is an exploded perspective view illustrating a detergent supply device of a washing machine according to one embodiment of the present invention, and FIG. 4 is a plane view illustrating a detergent box and a dispenser cover of a detergent supply device according to one embodiment of the present invention.

As shown in FIG. 3 or FIG. 4, the detergent supply device 200 of the washing machine according to the present invention includes a dispenser 220 provided to be communicated between the water supply device 150 and the tub 120, and a detergent box 210 accommodated through the draw-out hole 114 to be arranged inside the dispenser 220 and provided with a plurality of accommodating portions 212, 214 and 216.

The detergent box 210 is provided with a powder detergent accommodating portion 212 formed at one side to accommodate powder detergents used for main washing and pre-washing therein, and a fabric softener accommodating portion 214 and a bleach accommodating portion 216 formed at the other side to respectively accommodate a fabric softener and a bleach therein.

In this case, the powder detergent accommodating portion 212 is longitudinally formed at one side of the detergent box 210 in a length direction of the detergent box 210, and has an upper surface, which is opened to allow the powder detergent to be put therein, and a rear surface which is opened to discharge the powder detergent or washing water to the inside of the dispenser 220.

The fabric softener accommodating portion 214 and the bleach accommodating portion 216 are arranged at the other side of the detergent box 210, and are respectively formed at the front and the rear in a shape of a box of which upper surface is opened at a position spaced apart from the bottom of a rear portion of the powder detergent accommodating portion 212 at a predetermined height.

Meanwhile, a syphon pipe (nots shown) is upwardly protruded on the bottom of the fabric softener accommodating portion 214, and a fabric softener accommodating cap 214*a* forming a syphon pipe and a drainage path is provided on the fabric softener accommodating portion 214. The fabric softener accommodating cap 214*a* is formed to cover the upper surface of the fabric softener accommodating portion 214 and coupled to the fabric softener accommodating portion 214 by a hook, and is provided with a fabric softener insertion hole 214*b* formed at one side to insert the fabric softener thereinto.

A syphon pipe (nots shown) is upwardly protruded on the bottom of the bleach accommodating portion 216, and a bleach accommodating cap 216*a* forming a syphon pipe and a drainage path on the bleach accommodating portion 216. The bleach accommodating cap 216*a* is formed to cover the upper surface of the bleach accommodating portion 216 and coupled to the bleach accommodating portion 216 by a hook, and is provided with a bleach insertion hole 214*b* formed at one side to insert the bleach thereinto.

The dispenser 220 includes a dispenser housing 222 provided to be connected with a draw-out hole 114 on the rear surface of the control panel 117, having a front surface and an upper surface, which are opened, and a dispenser cover 228 provided with water supply holes 238*a*, 238*b* and 238*c* formed on the opened surface of the dispenser housing 222, supplying washing water to the accommodating portions 212, 214 and 216 of the detergent box 210.

In this case, the dispenser housing 222 is provided with a drainage hole 224 connected with the water bellows 226 to allow the washing water and the detergent dropped from the detergent box 210 to be supplied to the tub 120 through the water supply bellows 226.

The dispenser cover 228 includes a lower panel 230 provided on the opened surface of the dispenser housing 222 and provided with water supply paths 234*a*, 234*b* and 234*c*, and an upper panel 240 provided above the lower panel 230.

The lower panel 230 is provided with hose connecting units 232*a*, 232*b* and 232*c* protruded to be communicated with a rear portion and connected with the water supply hoses 152, 154 and 156 of the water supply device 150, water supply holes 238*a*, 238*b* and 238*c* respectively formed at positions corresponding to the powder detergent accommodating portion 212, the fabric softener accommodating portion 214 and the bleach accommodating portion 216 of the detergent box 210 to supply washing water, and a spray nozzle connecting unit 232*d* connected with the spray nozzle, supplying the washing water.

The water supply holes 238*a*, 238*b* and 238*c* are comprised of the powder detergent water supply hole 238*a* formed at an upper side of the powder detergent accommodating portion 212 to supply washing water to the powder detergent accommodating portion 212, the fabric softener water supply hole 238*b* formed at an upper side of the fabric softener accommodating portion 214 to supply washing water to the fabric softener accommodating portion 214, and the bleach water supply hole 238*c* formed at an upper side of the bleach accommodating portion 216 to supply washing water to the bleach accommodating portion 216.

The powder detergent water supply hole 238*a* may be provided with a plurality of holes fully formed to correspond to the powder detergent accommodating portion 212, and the single bleach water supply hole 238*c* and the single fabric softener water supply hole 238*b* may be provided to correspond to the bleach insertion hole 216*b* and the fabric softener insertion hole 214*b*.

Meanwhile, the hose connecting units 232*a*, 232*b* and 232*c* are comprised of a hot water hose connecting unit 232*a* connected with the hot water hose 152, and first and second cold water hose connecting units 232*b* and 232*c* connected with the first and second cold water hoses 154 and 156. The water supply paths 234*a*, 234*b* and 234*c* for guiding movement of washing water from the hose connecting units 232*a*, 232*b* and 232*c* to the water supply holes 238*a*, 238*b* and 238*c* are formed inside the upper panel 240 and the lower panel 230.

The water supply paths 234*a*, 234*b* and 234*c* are comprised of the powder detergent water supply path 234*a* for guiding hot water or cold water from the hot water hose connecting unit 232*a* or the first cold water hose connecting unit 232 to the first powder detergent water supply hole 238*a*, the divergence water supply path 234*b* for guiding cold water from the second cold water hose connecting unit 232*c* to the bleach water supply hole 238*c* and the spray nozzle connecting unit 232*d*, and the fabric softener water supply path 234*c* for guiding washing water from the first and second cold water hose connecting units 232*b* and 232*c* to the fabric softener water supply hole 238*b*.

In this case, the powder detergent water supply path 234*a* is connected with the hot water hose connecting unit 232*a* and the first cold water hose connecting unit 232*b*, and is formed to guide washing water supplied from the hot water hose connecting unit 232*a* and the first cold water hose connecting unit 232*b* to the powder detergent water supply hole 238*a*. That is, the hot water washing water supplied from the hot water hose connecting unit 232*a* or washing water supplied from the first cold water hose connecting unit 232*b* may be supplied to the powder detergent water supply path 234*a* simultaneously or selectively.

The divergence water supply path 234*b* guides the washing water supplied from the second cold water hose connecting unit 232*c* to the bleach water supply hole 238*c* and the spray nozzle connecting unit 232*d*. To this end, the divergence water supply path 234*b* forms a path connected to the spray nozzle connecting unit 232*d*, and is provided with a partition portion 235 connected to the bleach water supply hole 238*c* in the middle of the divergence water supply path 234*b*. In this case, the partition portion 235 is provided with a divergence portion 236 formed to partially guide washing water moving along the divergence water supply path 234*b* to the bleach water supply hole 238*c*.

The divergence portion 236, as shown in an enlarged portion of FIG. 4, is formed to be protruded from one side of the divergence water supply path 234*b* toward the inner side of the divergence water supply path 234*b* to partially guide washing water moving along the divergence water supply path 234*b* to the bleach water supply hole 238*c*, and is protruded at one side of the partition portion 235 toward the divergence water supply path 234*b*.

That is, the divergence portion 236 may be protruded in an opposite direction of a moving direction of washing water moving through the divergence water supply path 234*b*, and the amount of washing water passing through the divergence water supply path 234*b* and then entering the partition portion 235 may be controlled by an angle of the divergence portion 236 extended to the inner side of the divergence water supply path 234*b*.

Therefore, the washing water moving along the divergence water supply path 234*b* partially moves to the bleach water supply hole 238*c* by means of the divergence portion 236, and the other washing water moves to the spray nozzle connecting unit 232*d* and then is supplied to the spray nozzle. In this case, a flow rate of the washing water supplied to the bleach water supply hole 238*c* may be controlled by controlling a forming angle of the divergence portion 236.

Meanwhile, the powder detergent water supply path 234*a* connected to the first cold water hose connecting unit 232*b* and the divergence water supply path 234*b* connected to the second cold water connecting unit 232*c* are formed to cross each other, and the fabric softener water supply path 234*c* for guiding the washing water to the fabric softener water supply hole 238*b* is formed at the portion where the powder detergent water supply path 234*a* and the divergence water supply path 234*b* cross each other.

In this case, the fabric softener water supply path 234*c* is provided in such a manner that the washing water simultaneously supplied from the first cold water hose connecting unit 232*b* and the second cold water connecting unit 232*c* is supplied to the fabric softener water supply path 234*c* when the washing water supplied from the first cold water hose connecting unit 232*b* and the washing water supplied from the second cold water hose connecting unit 232*c* collide with each other.

That is, if the first cold water hose connecting unit 232*b* and the second cold water hose connecting unit 232*c* are supplied individually, the first cold water hose connecting unit 232*b* and the second cold water hose connecting unit 232*c* are individually supplied to the powder detergent water supply path 234*a* and the divergence water supply path 234*b*, and the washing water may be supplied to the fabric softener water supply path 234*c* only if the washing water is simultaneously supplied from the first cold water hose connecting unit 232*b* and the second cold water hose connecting unit 232*c*.

The operation of the detergent supply device of the washing machine according to the present invention configured as above is as follows.

First of all, if laundry is inserted into the drum 130 of the washing machine 100 and at the same time a detergent is inserted into the detergent box 210, the detergent is supplied into the tub 120 together with the washing water supplied by the water supply device 150, and the drum 130 is rotated by the motor, whereby washing of the laundry is performed.

At this time, the detergent box 210 is drawn out toward the front of the draw-out hole 114 of the control panel 117 and then a powder detergent, a bleach and a fabric softener are respectively inserted into the powder detergent accommodating portion 212, the bleach accommodating portion 216 and the fabric softener accommodating portion 214.

Afterwards, if the powder detergent, the bleach and the fabric softener are respectively inserted into the powder detergent accommodating portion 212, the bleach accommodating portion 216 and the fabric softener accommodating portion 214 at a suitable content, the detergent box 210 is accommodated into the draw-out hole 114 of the control panel 117 and then arranged inside the dispenser 220.

Meanwhile, if the washing machine 100 is operated, the washing water enters the inside of the dispenser cover 228 through the hose connecting units 232*a*, 232*b* and 232*c* connected with the water supply hoses 152, 154 and 156 of the water supply device 150, and the washing water entering the inside of the dispenser cover 228 moves along the water supply paths 234*a*, 234*b* and 234*c* and then is supplied into the detergent accommodating portions 212, 214 and 216 of the detergent box 210 through the water supply holes 238*a*, 238*b* and 238*c*.

That is, the cold water entering through the first cold water hose connecting unit 232*b* of the dispenser 220 moves along the powder detergent water supply path 234*a* and then is supplied to the powder detergent accommodating portion 212 of the detergent box 210 through powder detergent water supply hole 238*a*.

Therefore, the powder detergent inside the powder detergent accommodating portion 212 is dropped toward the dispenser housing 222 together with the cold water supplied through the powder detergent water supply hole 238*a* and then supplied into the tub 120 through the bellows 226 connected to the drainage hole 224 of the dispenser housing 222.

Meanwhile, the powder detergent inside the powder detergent accommodating portion 212 may be dropped toward the dispenser housing 222 together with the hot water or the cold water supplied through the powder detergent water supply hole 238*a* and then supplied into the tub 120 through the bellows 226 connected to the drainage hole 224 of the dispenser housing 222.

Also, the cold water entering through the second cold water hose connecting unit 232*c* of the dispenser 220 moves along the divergence water supply path 234*b* and then may partially be supplied to the bleach water supply hole 238*c* through the partition portion by means of the divergence portion formed in the divergence water supply path 234*b* and the other washing water may be supplied to the spray nozzle through the spray nozzle connecting unit 232*d*.

Therefore, the washing water supplied through the second cold water hose connecting unit 232*c* may be used if the washing water is sprayed for wetting of laundry accommodated in the drum 130 by the spray nozzle, or may be used to supply the bleach accommodated in the bleach accommodating portion 216.

Meanwhile, as the washing water is simultaneously supplied from the first and second cold water hose connecting units 232*b* and 232*c*, the washing water supplied from the first and second cold water hose connecting units 232*b* and 232*c* moves along the fabric softener water supply path 234*c*, and the fabric softener supplied to the fabric softener accommodating portion 214 is dropped to the dispenser housing 222 through the fabric softener insertion hole 214*b* and then supplied into the tub 120 through the bellows 226 connected to the drainage hole 2224 of the dispenser housing 222.

Since the bleach aqueous solution and the fabric softener aqueous solution dropped to the dispenser housing 222 as above are supplied into the tub 120 through the bellows 226 connected to the drainage hole 224 of the dispenser housing 222, the bleach aqueous solution may be supplied into the tub 120 during pre-washing or main washing of laundry, and the fabric softener aqueous solution may be supplied into the tub 120 during rinsing of laundry.

Therefore, according to the detergent supply device of the washing machine of the present invention, it is possible to reduce the water supply valves for supplying washing water to the detergent supply device by improving the paths of the detergent supply device, and it is possible to reduce processes according to manufacture of the washing machine.

It will be apparent to those skilled in the art that the present invention may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A detergent supply device of a washing machine, comprising:

a dispenser disposed at a water supply passage of the washing machine and connected to a plurality of hoses; and a detergent box configured to be drawn out from an inside of the dispenser, the detergent box defining a plurality of detergent accommodating portions, a number of the plurality of detergent accommodating portions being greater than a number of the plurality of hoses, wherein the dispenser comprises:

at least one supply path that is configured to guide washing water received from one of the plurality of hoses to at least two of the plurality of detergent accommodating portions, a lower panel that comprises a plurality of connecting units connected to the plurality of hoses and that defines a plurality of water supply paths configured to guide washing water supplied from each of the plurality of connecting units to the plurality of detergent accommodating portions, and an upper panel that covers an upper portion of the lower panel, and wherein at least one of the plurality of water supply paths comprises:

a partition portion defining a space at one side of the at least one of the plurality of water supply paths, the space being configured to receive a portion of washing water supplied from the plurality of connection units, and a divergence portion that extends from the partition portion in a direction opposite to a moving direction of washing water in the at least one of the plurality of water supply paths, the divergence portion being configured to guide the portion of washing water to the partition portion.

2. The detergent supply device of claim 1, wherein the dispenser comprises:

a dispenser housing that is disposed at a side of the washing machine, that defines a dispenser space configured to receive the detergent box, and that is configured to guide detergent and washing water to a tub of the washing machine; and a dispenser cover disposed at an upper portion of the dispenser housing and configured to supply washing water to each of the plurality of detergent accommodating portions, and wherein the detergent box is configured to be withdrawn from the dispenser space.

3. The detergent supply device of claim 1, wherein the partition portion extends from one of the plurality of connecting units and is configured to supply a first portion of washing water to one of the plurality of detergent accommodating portions and a second portion of washing water to another of the plurality of detergent accommodating portions.

4. The detergent supply device of claim 1, wherein the detergent box is configured to be positioned at a position vertically below the lower panel in the dispenser housing.

5. The detergent supply device of claim 1, wherein the dispenser defines:

a first water supply hole that is configured to communicate with a first detergent accommodating portion of the plurality of detergent accommodating portions; and a second water supply hole that is configured to communicate with a second detergent accommodating portion of the plurality of detergent accommodating portions, and wherein the at least one supply path passes the first water supply hole and the second water supply hole.

6. The detergent supply device of claim 1, wherein the partition portion protrudes laterally outward from the at least one of the plurality of water supply paths.

7. The detergent supply device of claim 1, wherein the divergence portion extends from an inlet of the partition portion to thereby cover at least a portion of the space in the partition portion.

8. The detergent supply device of claim 1, wherein the partition portion comprises a first end and a second end that are connected to the at least one of the plurality of water supply paths, the second end being located downstream relative to the first end along the moving direction of washing water, and wherein the divergence portion extends from the second end of the partition portion toward the first end of the partition portion.

9. The detergent supply device of claim 8, wherein the divergence portion is spaced apart from the first end of the partition portion and covers a portion of an inlet of the partition portion defined between the first end and the second of the partition portion.

10. The detergent supply device of claim 1, wherein the partition portion is in contact with the divergence portion.

11. A detergent supply device of a washing machine, comprising:

a dispenser connected to a plurality of hoses and configured to receive washing water from the plurality of hoses; and a detergent box configured to insert into and withdrawn from the dispenser, the detergent box defining a plurality of detergent accommodating portions, wherein the dispenser defines:

a first water supply hole that is configured to communicate with a first detergent accommodating portion of the plurality of detergent accommodating portions, a second water supply hole that is configured to communicate with a second detergent accommodating portion of the plurality of detergent accommodating portions, and a water supply path that passes the first water supply hole and the second water supply hole and that is configured to supply a first portion of washing water to the first detergent accommodating portion and a second portion of washing water to the second detergent accommodating portion, wherein the dispenser comprises a plurality of partitions that define the water supply path, wherein at least one of the plurality of partitions comprises:

a partition portion that protrudes laterally outward from the water supply path and that is configured to receive the first portion of washing water, and a divergence portion that extends from an inlet of the partition portion in a direction opposite to a moving direction of washing water in the water supply path and that is configured to guide the first portion of washing water to the partition portion, and wherein the divergence portion is bent toward the water supply path.

12. The detergent supply device of claim 11, wherein the first water supply hole is defined at a bottom surface of the dispenser within the partition portion.

13. The detergent supply device of claim 12, wherein the second water supply hole is defined at a lateral side surface of the dispenser or at the bottom surface of the dispenser outside of the partition portion.

14. The detergent supply device of claim 11, wherein the dispenser comprises:

a dispenser housing that is disposed at a side of the washing machine, that defines a dispenser space configured to receive the detergent box, and that is configured to guide detergent and washing water to a tub of the washing machine; and a dispenser cover disposed at an upper portion of the dispenser housing and configured to supply washing water to each of the plurality of detergent accommodating portions.

15. The detergent supply device of claim 14, wherein the dispenser cover defines the first water supply hole, the second water supply hole, and the water supply path.

16. The detergent supply device of claim 14, wherein the dispenser cover comprises:

a lower panel configured to be positioned vertically above the detergent box;

a plurality of connecting units that connect the plurality of hoses to the lower panel; and an upper panel that covers an upper portion of the lower panel, and wherein the lower panel defines the first water supply hole, the second water supply hole, and the water supply path.

* * * * *